US010030886B2

(12) United States Patent
Iino et al.

(10) Patent No.: US 10,030,886 B2
(45) Date of Patent: Jul. 24, 2018

(54) OUTDOOR UNIT OF REFRIGERATION APPARATUS

(71) Applicant: DAIKIN INDUSTRIES, LTD., Osaka-shi, Osaka (JP)

(72) Inventors: Shunya Iino, Kusatsu (JP); Kazuyoshi Taguchi, Kusatsu (JP); Fumio Ohta, Kusatsu (JP); Minoru Nishikawa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 469 days.

(21) Appl. No.: 14/357,735

(22) PCT Filed: Oct. 22, 2012

(86) PCT No.: PCT/JP2012/077196
§ 371 (c)(1),
(2) Date: May 12, 2014

(87) PCT Pub. No.: WO2013/073338
PCT Pub. Date: May 23, 2013

(65) Prior Publication Data

US 2014/0323031 A1 Oct. 30, 2014

(30) Foreign Application Priority Data

Nov. 14, 2011 (JP) ..... 2011-248667

(51) Int. Cl.
*F24F 13/20* (2006.01)
*F24F 1/56* (2011.01)
*F24F 1/36* (2011.01)

(52) U.S. Cl.
CPC ..... *F24F 13/20* (2013.01); *F24F 1/36* (2013.01); *F24F 1/56* (2013.01); *F24F 2221/52* (2013.01)

(58) Field of Classification Search
CPC ..... F24F 13/20
See application file for complete search history.

(56) References Cited

U.S. PATENT DOCUMENTS 349,894 A * 9/1886 McKenzie ..... E06B 7/14 16/97
2,892,424 A * 6/1959 Mondi ..... F24F 13/20 52/3

(Continued)

FOREIGN PATENT DOCUMENTS

EP 2 278 230 A2 1/2011
JP 58-69766 U 5/1983

(Continued)

OTHER PUBLICATIONS

European Search Report of corresponding EP Application No. 12 85 0290.3 dated Jul. 3, 2015.

(Continued)

*Primary Examiner* — Nathaniel Herzfeld
(74) *Attorney, Agent, or Firm* — Global IP Counselors, LLP

(57) ABSTRACT

In an outdoor unit of a refrigeration apparatus is a blow-out opening configured to deliver air from an air-blowing fan that is covered by a protective grill. The outdoor unit includes an eave part protruding in a direction along which the air is blown out from a top part of the grill. A top surface of the eave part has a water-leading part extending in a direction intersecting the direction along which the air is blown out. The water-leading part leads water dripping down onto the top surface of the eave part to at least one of longitudinal ends of the eave part and a middle of the eave part.

10 Claims, 5 Drawing Sheets

(56) References Cited

U.S. PATENT DOCUMENTS 4,353,680 A * 10/1982 Hiraoka ..... F04D 29/646 415/201
5,476,316 A * 12/1995 Batroney ..... H02B 1/38 312/100
5,575,622 A * 11/1996 Zimmerman ..... F04D 29/703 415/213.1
8,365,487 B2 * 2/2013 Krusec ..... E04D 13/1693 52/11
9,194,593 B2 * 11/2015 Uselton ..... F24F 1/58
2006/0059935 A1 * 3/2006 Braswell ..... F24F 1/58 62/259.1
2006/0125355 A1 * 6/2006 Hauck ..... A47B 47/00 312/100
2009/0277113 A1 * 11/2009 Taraba ..... E04D 3/352 52/302.1
2010/0081371 A1 * 4/2010 Dinicolas ..... F24F 13/20 454/275
2010/0319380 A1 * 12/2010 Mochizuki ..... F24F 1/06 62/259.1
2015/0247649 A1 * 9/2015 Tanikawa ..... F24F 13/224 3/224

FOREIGN PATENT DOCUMENTS

JP 6-78724 A 11/1994
JP 2000-104952 A 4/2000
JP 2011-2167 A 1/2011
JP 2011-94919 A 5/2011
JP 2012-154581 A 8/2012

OTHER PUBLICATIONS

International Preliminary Report of corresponding PCT Application No. PCT/JP2012/077196 dated May 30, 2014.
International Search Report of corresponding PCT Application No. PCT/JP2012/077196.

* cited by examiner

OUTDOOR UNIT OF REFRIGERATION APPARATUS

CROSS-REFERENCE TO RELATED APPLICATIONS

This U.S. National stage application claims priority under 35 U.S.C. § 119(a) to Japanese Patent Application No. 2011-248667, filed in Japan on Nov. 14, 2011, the entire contents of which are hereby incorporated herein by reference.

TECHNICAL FIELD

The present invention relates to an outdoor unit of a refrigeration apparatus.

BACKGROUND ART

Because an outdoor unit of a refrigeration apparatus is exposed to outside air, rain and/or melted snow water falls down from the top of a casing and gets in between a bell mouth and a fan, and ultimately this water freezes and interferes with the fan. Therefore, in the outdoor unit disclosed in Japanese Laid-open Patent Application No. 2011-2167, an eave member is provided in the top of a blow-out grill to prevent water from getting in between the bell mouth and the fan.

SUMMARY

Technical Problem

In an outdoor unit such as the one described above, water accumulated on the eave member drips down onto the front surface of the blow-out grill and is blown into the blown air, but water dripping down into locations where air speed is slow, such as the end of the blow-out port, spreads over the blow-out grill and gets in between the bell mouth and the fan rather than being blown out, and in the worst cases the water freezes and interferes with the fan.

An object of the present invention is to provide an outdoor unit in which water does not flow to locations, where air speed is slow such as the end of the blow-out port.

Solution to Problem

An outdoor unit of a refrigeration apparatus according to a first aspect of the present invention is an outdoor unit of a refrigeration apparatus in which a blow-out opening for air delivered from an air-blowing fan is covered by a protective grill, the outdoor unit includes an eave part. The eave part protrudes in the direction in which the air is blown out from the top part of the grill. The top surface of the eave part is provided with a water-leading part extending in a direction intersecting the direction in which the air is brown out. The water-leading part leads water dripping down onto the top surface of the eave part to the longitudinal ends and/or middle of the eave part.

In this outdoor unit, water dripping down onto the top surface of the eave part spreads through the water-leading part and moves to the eave ends or middle. The water that has moved to the eave ends fails down over the grill side surface to the ground. The water that has moved to the middle of the eave part falls down to the front of the grill, but this water is scattered into the air blown from the air-blowing fan and therefore does not adhere to the grill. As a result, water is prevented from freezing and growing on the grill front surface.

An outdoor unit of a refrigeration apparatus according to a second aspect of the present invention is the outdoor unit of the refrigeration apparatus according to the first aspect, wherein the water-leading part leads the water dripping down onto the top surface of the eave part to the longitudinal ends and middle of the eave part.

In this outdoor unit, water droplets are eliminated from three locations: the ends and the middle of the eave part, and the water droplets are therefore suppressed from remaining for long periods of time on the top surface of the eave part.

An outdoor unit of a refrigeration apparatus according to a third aspect of the present invention is the outdoor unit of the refrigeration apparatus according to the first or second aspect, wherein the middle of the eave part is positioned vertically above the rotational center axis of the air-blowing fan.

Water that has moved to the middle of the eave part drops down in front of the grill to be scattered into the air blown from the air-blowing fan, but it is possible for the water to adhere to the grill when the force of the blown air is low (the air speed is slow). However, in this outdoor unit, water falling down from the middle of the eave part passes in front of the center of the air-blowing fan due to the middle of the eave part being positioned vertically above the rotational center axis of the air-blowing fan, and the water that falls from the middle of the eave part is therefore endowed with a fast air speed and reliably blown out.

An outdoor unit of a refrigeration apparatus according to a fourth aspect of the present invention is the outdoor unit of the refrigeration apparatus according to any of the first through third aspects, wherein the water-leading part is a rib having a predetermined height.

In this outdoor unit, water droplets collect in the corner between the eave part top surface and the rib, and the collected water, being pushed by water droplets that continue to collect, can easily move along the rib.

An outdoor unit of a refrigeration apparatus according to a fifth aspect of the present invention is the outdoor unit of the refrigeration apparatus according to any of the first through third aspects, wherein the water-leading part is a groove having a predetermined depth.

In this outdoor unit, water that has dripped down onto the eave part top surface is drawn into and collected in the groove, and the collected water, being pushed by water that continues to be drawn in, moves through the groove and reaches the ends and middle of the eave part.

An outdoor unit of a refrigeration apparatus according to a sixth aspect of the present invention is the outdoor unit of the refrigeration apparatus according to the first through third aspects, wherein the water-leading part is an inclined surface where the longitudinal ends and middle of the eave part are formed lower than other areas.

In this outdoor unit, water that has dripped down onto the eave part top surface reliably reaches the ends and middle of the eave part due to the height difference.

Advantageous Effects of Invention

In the outdoor unit of the refrigeration apparatus according to the first aspect of the present invention, water dripping down onto the top surface of the eave part spreads through the water-leading part and moves to the eave ends or middle. The water that has moved to the eave ends falls down over the grill side surface to the ground. The water that has moved to the middle of the eave part falls down to the front of the grill, but this water is scattered into the air blown from the air-blowing fan and therefore does not adhere to the grill. As a result, water is prevented from freezing and growing on the grill front surface.

In the outdoor unit of the refrigeration apparatus according to the second aspect of the present invention, water droplets are eliminated from three locations: the ends and the middle of the eave part, and the water droplets are therefore suppressed from remaining for long periods of time on the top surface of the eave part.

In the outdoor unit of the refrigeration apparatus according to the third aspect of the present invention, due to the middle of the eave part being positioned vertically above the rotational center axis of the air-blowing fan, the water that fails from the middle of the eave part is endowed with a fast air speed and reliably blown out.

In the outdoor unit of the refrigeration apparatus according to the fourth aspect of the present invention, water droplets collect in the corner between the eave part top surface and the rib, and the collected water, being pushed by water droplets that continue to collect, can easily move along the rib.

In the outdoor unit, of the refrigeration apparatus according to the fifth aspect of the present invention, water that has dripped down onto the eave part top surface is drawn into and collected in the groove, and the collected wafer, being pushed by water that continues to be drawn in, moves through the groove and reaches the ends and middle of the eave part.

In the outdoor unit of the refrigeration apparatus according to the sixth aspect of the present invention, water that has dripped down onto the eave part top surface reliably reaches the ends and middle of the eave part due to the height difference.

DESCRIPTION OF EMBODIMENTS

An embodiment of the present invention is described below with reference to the drawings. The following embodiment is a specific example of the present invention and is not intended to limit the technological scope of the present invention.

(1) Configuration of Air Conditioning Apparatus 1

Figure 1:
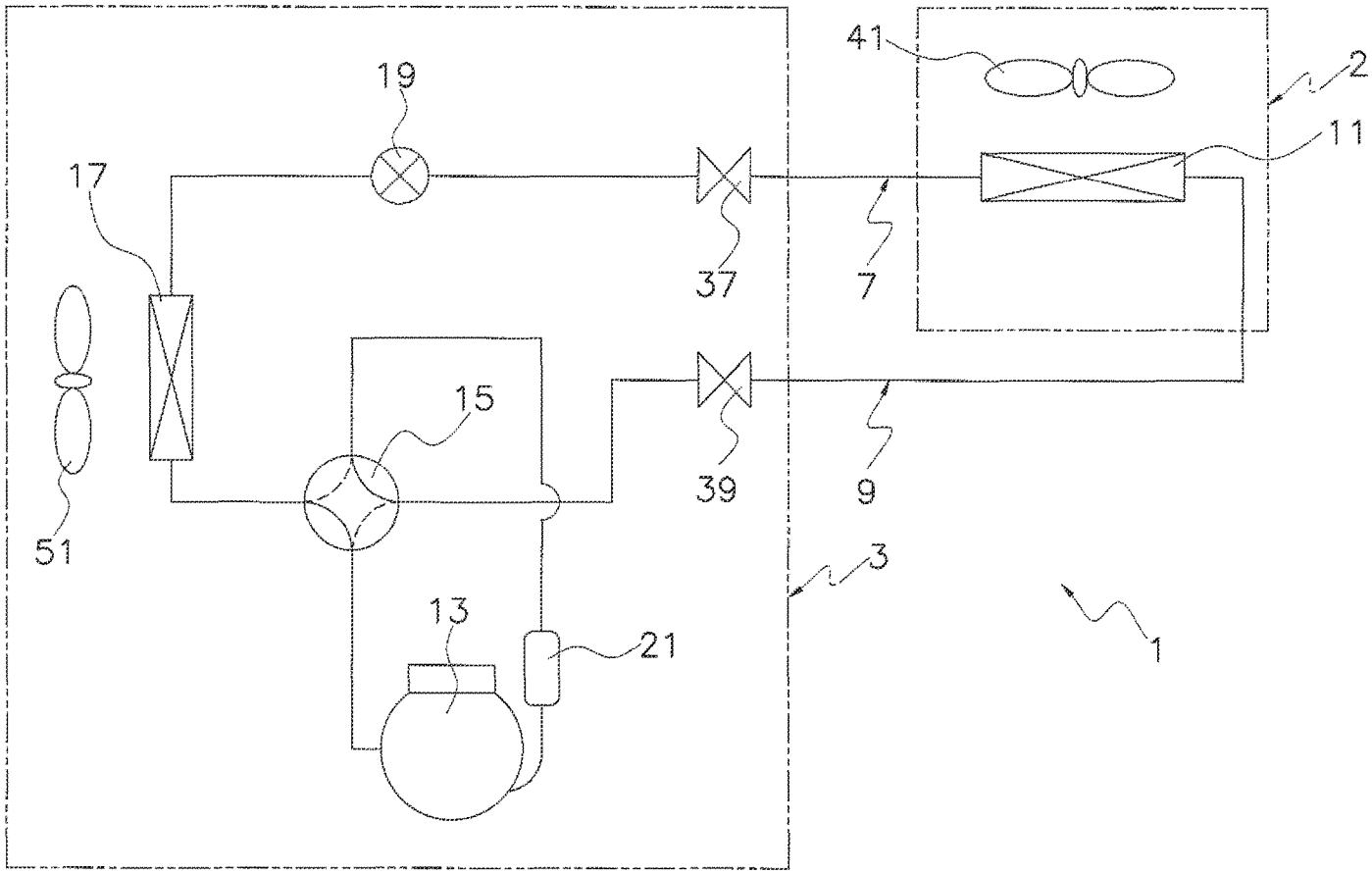
FIG. 1 is a configuration diagram of an air conditioning apparatus that uses an outdoor unit according to an embodiment of the present invention.

FIG. 1 is a configuration diagram of an air conditioning apparatus 1 that uses an outdoor unit according to an embodiment of the present invention. In FIG. 1, the air conditioning apparatus 1 is capable of an air-cooling operation and an air-warming operation, and the air conditioning apparatus includes an indoor unit 2, an outdoor unit 3, a liquid refrigerant communication tube 7 and a gas refrigerant communication tube 9 for connecting the outdoor unit 3 and the indoor unit 2, a liquid-side shutoff valve 37, and a gas-side shutoff valve 39.

The liquid-side shutoff valve 37 and the gas-side shutoff valve 39 are connected to the liquid refrigerant communication tube 7 and the gas refrigerant communication tube 9, respectively. The liquid refrigerant communication tube 7 connects the liquid side of an indoor heat exchanger 11 of the indoor unit 2 and the liquid-side shutoff valve 37 of the outdoor unit 3. The gas refrigerant communication tube 9 connects the gas side of the indoor heat exchanger 11 of the indoor unit 2 and the gas-side shutoff valve 39 of the outdoor unit 3.

(1-1) Indoor Unit 2

In FIG. 1, the indoor unit 2 has the indoor heat exchanger 11 and an indoor fan 41. The indoor heat exchanger 11, which is a cross-fin type heat exchanger, can evaporate or condense refrigerant flowing therein by heat exchange with the indoor air, and can cool or heat the indoor air.

(1-2) Outdoor Unit 3

In FIG. 1, the outdoor unit 3 has primarily a compressor 13, a four-way switching valve 15, an outdoor heat exchanger 17, an expansion valve 19, an accumulator 21, the liquid-side shutoff valve 37, and the gas-side shutoff valve 39. Furthermore, the outdoor unit 3 has an outdoor fan 51 as well.

(2) Detailed Configuration of the Outdoor Unit 3

(2-1) Compressor 13, Four-Way Switching Valve 15, and Accumulator 21

The compressor 13 draws in and compresses gas refrigerant. The accumulator 21 is disposed in front of the intake port of the compressor 13, and liquid refrigerant is not directly drawn into the compressor 13.

The four-way switching valve 15 switches the direction of refrigerant flow during a switch between the air-cooling operation and the air-warming operation. During the air-cooling operation, the four-way switching valve 15 connects the discharge side of the compressor 13 and the gas side of the outdoor heat exchanger 17, and also connects the intake side of the compressor 13 and the gas-side shutoff valve 39. In other words, the four-way switching valve 15 is in the state shown by the solid lines in FIG. 1.

During the air-warming operation, the four-way switching valve 15 connects the discharge side of the compressor 13 and the gas-side shutoff valve 39, and also connects the intake side of the compressor 13 and the gas side of the outdoor heat exchanger 17. In other words, the four-way switching valve 15 is in the state shown by the dashed lines in FIG. 1.

(2-2) Outdoor Heat Exchanger 17 and Outdoor Fan 51

The outdoor heat exchanger 17 can condense or evaporate refrigerant flowing therein by heat exchange with outdoor air. The outdoor fan 51, which is disposed so as to face the outdoor heat exchanger 17, takes in and blows outdoor air to the outdoor heat exchanger 17 by rotating, and promotes heat exchange between the outdoor heat exchanger 17 and the outdoor air.

(2-3) Expansion Valve 19

The expansion valve 19, which is connected to the tubing between the outdoor heat exchanger 17 and the liquid-side shutoff valve 37, has the function of expanding refrigerant during both the air-cooling operation and the air-warming operation in order to adjust refrigerant pressure and/or refrigerant flow rate.

(2-4) Main Body Casing 23

Figure 2:
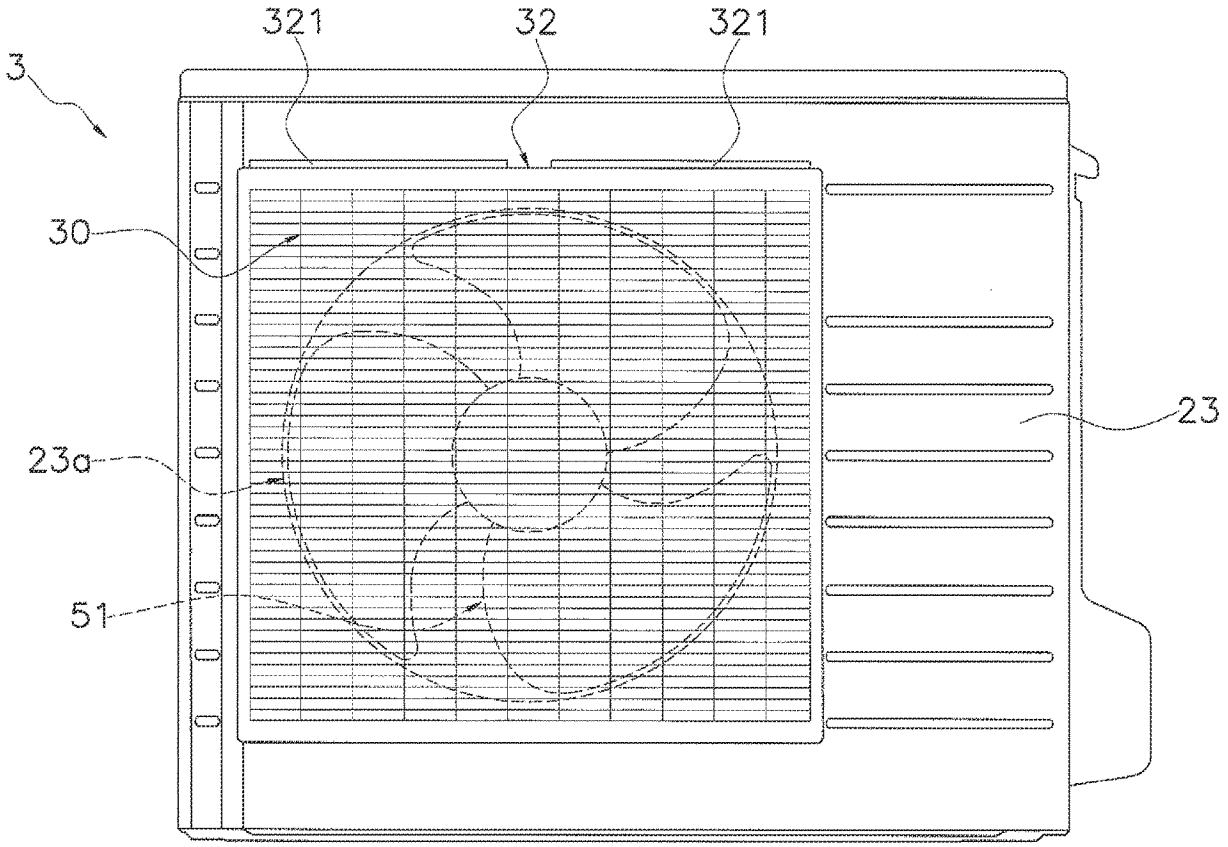
FIG. 2 is a front view of the outdoor unit.
Figure 3:
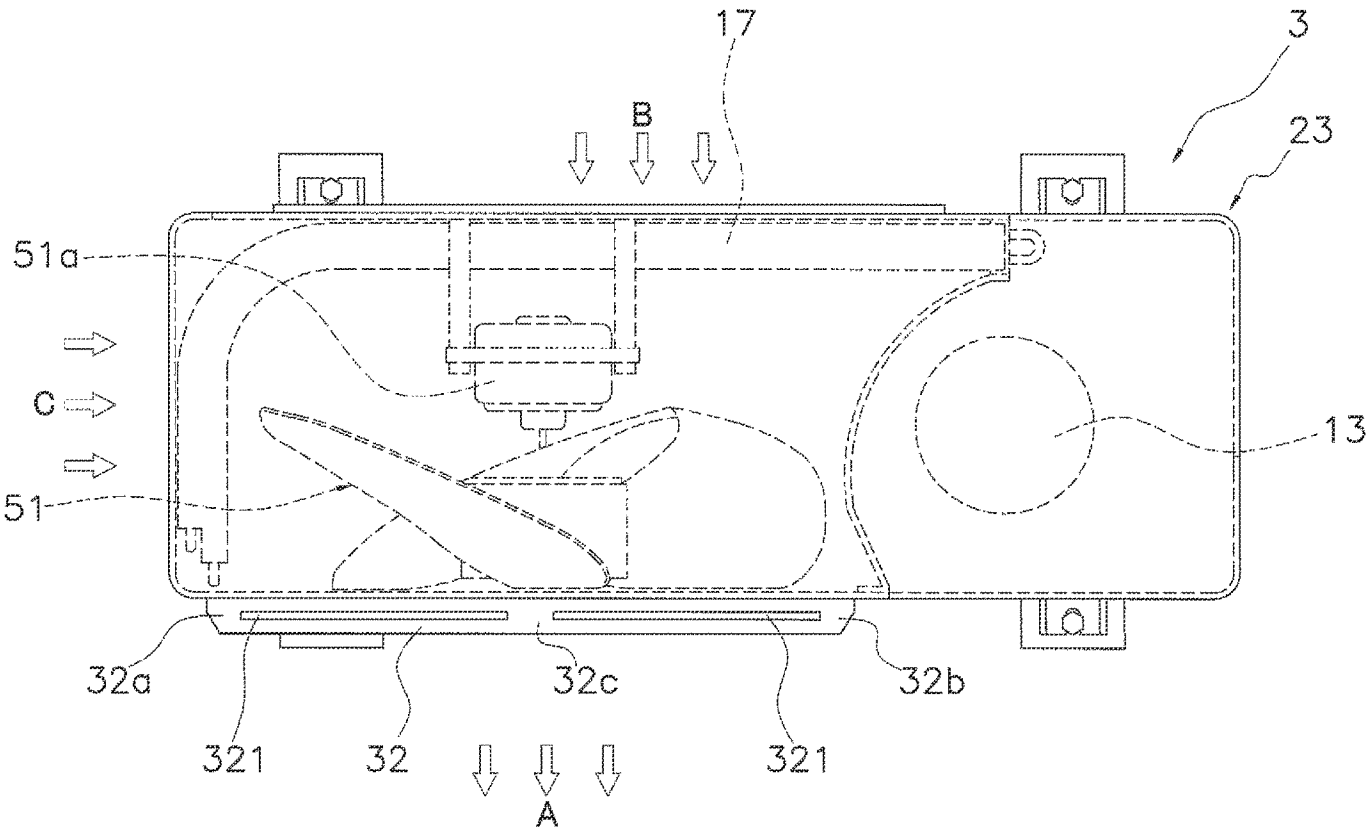
FIG. 3 is a plan view of the outdoor unit.

FIG. 2 is a front view of the outdoor unit 3. FIG. 3 is a plan view of the outdoor unit. In the outdoor unit 3 in FIGS. 2 and 3, the members necessary for the configuration of a vapor-compression refrigeration cycle, such as the outdoor fan 51, the compressor 13, the outdoor heat exchanger 17, and the tubing, are stored inside a main body casing 23 which forms the outer shell.

In FIG. 3, when the outdoor fan 51 is running, air is drawn in from the directions B and C, the air undergoes heat exchange with the outdoor heat exchanger 17, and the air is then blown out in the direction A.

(2-5) Outdoor Fan 51

In FIGS. 2 and 3, the outdoor fan 51, which is a propeller fan having a plurality of blades, is disposed on the front side of the outdoor heat exchanger 17 so as to face a blow-out port 23*a* (see FIG. 2). The outdoor fan 51 is rotatably driven by a fan motor 51*a*.

(2-6) Grill 30

A grill 30 is a latticed protective member covering the blow-out port 23*a*, as shown in FIG. 2. Air blown out from the outdoor fan 51 is blown out through the grill 30 via the blow-out port 23*a*. An eave part 32 is provided on the top of the grill 30.

(2-7) Eave Part 32

Figure 4:
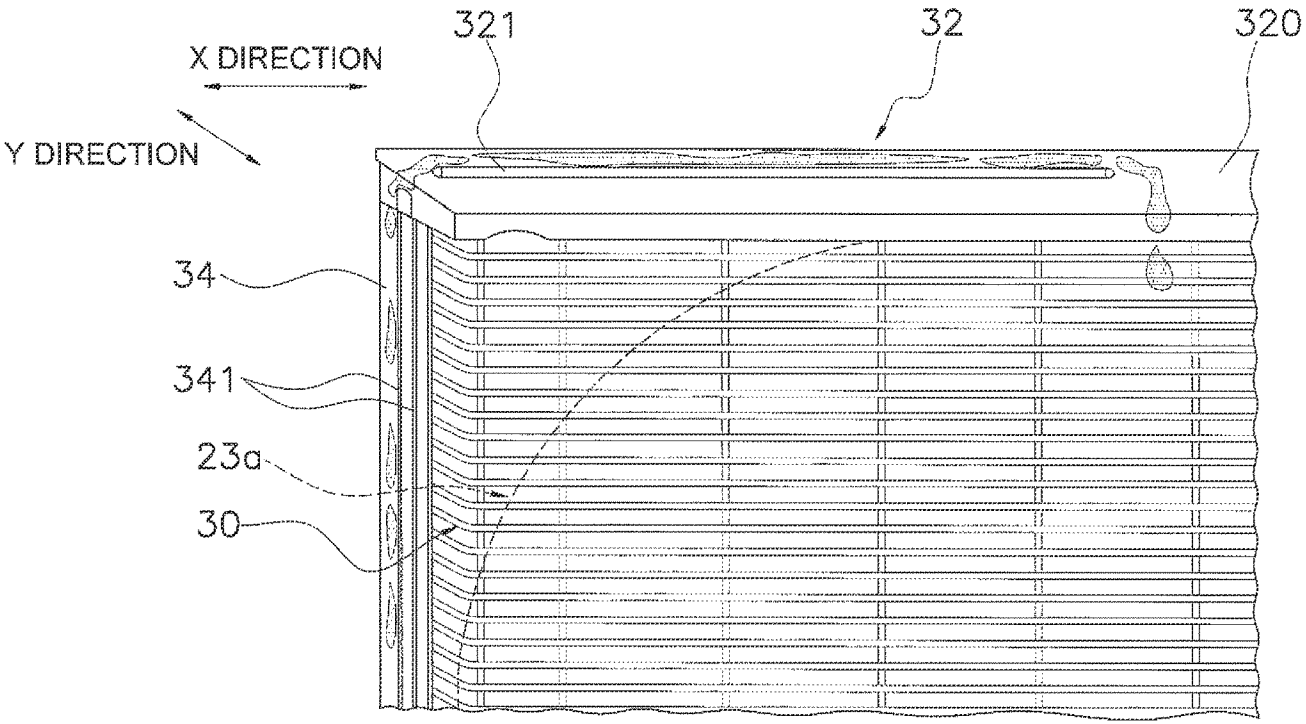
FIG. 4 is an enlarged perspective view of an upper left part of a grill.

FIG. 4 is an enlarged perspective view of the upper left part of the grill 30. In FIG. 4, the eave part 32 protrudes in the direction in which air is blown out from the top part of the grill 30. The eave part 32 catches water droplets falling from the roof of the main body casing 23 and temporarily retains the water droplets so that the water droplets do not pass through the grill 30 and get between the outdoor fan 51 and the blow-out port 23*a* (commonly a bell mouth outlet).

The top surface 320 of the eave part 32 is flat, and a lateral rib 321 extending laterally (in the X direction in FIG. 4) is formed in the depth-wise (in the Y direction in FIG. r) rear half of the top surface. In the present embodiment, the height of the lateral rib 321 is set to approximately 2 mm.

Two lateral ribs 321 are adjacent across a predetermined gap, as is also shown in FIG. 3. The gap between the two lateral ribs 321 is positioned in the middle 32*c* of the lateral length of the eave part 32. This eave part 32 is positioned vertically above the rotational center axis of the outdoor fan 51.

A holding plate 34 as shown in FIG. 4 is provided vertically below the left end 32*a* (on the left side in the front view of FIG. 3) and the right end 32*b* (on the right side in the front view of FIG. 3) of the eave part 32. The holding plate 34, which is positioned on the side surface of the grill 30, holds the roots of the wires constituting the lattice. Two vertical ribs 341 extending in the vertical direction are formed on the holding plate 34.

(3) Flow of Water Droplets Accumulated in Eave Part 32

When water droplets have grown so much as to accumulate in the eave part 32 as shown in FIG. 4, the water droplets come in contact with the lateral ribs 321 and move to the left end 32*a*, the right end 32*b*, and the middle 32*c* in a pulled manner.

Water dripping down in front of the grill 30 from the middle 32*c* is scattered by the force of the blown air. Because the middle 32*c* is positioned vertically above the rotational center axis of the outdoor fan 51, water dripping down from the middle 32*c* is subjected to the force of blown air having the highest speed, thereby becoming fine water droplets which are scattered farther. Therefore, the water droplets do not readily adhere to and freeze on the grill 30.

On the other hand, water dripping down to the sides from the left end 32*a* and the right end 32*b* spreads over the holding plate 34 and falls down. In this case, the effect of surface tension causes the water to be pulled to the vertical ribs 341, and the water then falls down along the vertical ribs 341 due to gravity. Therefore, the water falling down along the vertical ribs 341 is not pulled toward the grill 30 by the dynamic pressure of the blown air.

(4) Characteristics 4-1

In the outdoor unit 3, the top surface of the eave part 32 is provided with the lateral ribs 321 extending in a direction intersecting the direction in which air is blown. Water dripping down onto the top surface of the eave part 32 collects in the corner between the eave part 32 surface and the lateral ribs 321, and the collected water, being pushed by water droplets that continue to collect, can easily move along the lateral ribs 321. The lateral ribs 321 lead the water to at least one of the following: the left end 32*a*, the right end 32*b*, and the middle 32*c*.

4-2

The water led to the middle 32*c* of the eave part 32 falls down in front of the grill 30, but does not adhere to the grill 30 because the water is scattered into the air blown from the outdoor fan 51. As a result, water is prevented from freezing and growing on the front surface of the grill 30.

4-3

The water led to either or both the left end 32*a* and the right end 32*b* of the eave part 32 drips down to the sides of the grill 30 but falls down along the vertical ribs 341, and therefore does not adhere to the grill 30. As a result, water is prevented from freezing and growing on the side surfaces of the grill 30.

4-4

Furthermore, when the lateral ribs 321 lead the water dripping down onto the top surface of the eave part 32 to the left end 32*a*, the right end 32*b*, and the middle 32*c*, water droplets are eliminated from three locations, and the water droplets are therefore suppressed from remaining for long periods of time on the top surface of the eave part.

4-5

Because the middle 32*c* of the eave part. 32 is positioned vertically above the rotational center axis of the outdoor fan 51, water that has dripped down in front of the grill 30 from the middle 32*c* of the eave part 32 is reliably scattered, being subjected to the greatest, force of the air blown from the outdoor fan.

(5) Modifications

In the above embodiment, water is led by the lateral ribs 321 to the left end 32*a*, the right end 32*b*, and the middle 32*c* of the eave part 32, but the leading of water is not limited to lateral ribs and may be another shape.

(5-1) First Modification

Figure 5A:
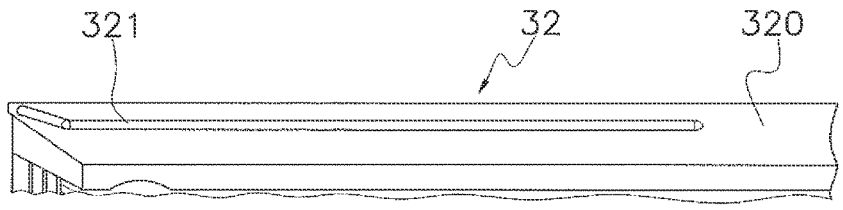
FIG. 5A is a perspective view of an eave part of an outdoor unit according to a first modification.

FIG. 5A is a perspective view of an eave part 32 of an outdoor unit. 3 according to a first modification. In FIG. 5A, a lateral rib 321 extending laterally is formed on the top surface 320 of the eave part 32. The difference from the above embodiment is that, of the two ends of the lateral rib 321, the end near the end of the eave part. 32 is bent in the depth direction.

Therefore, water that has moved to the left end and the right, end along the lateral ribs 321 remains there. The water accumulates to a certain extent and thereby moves toward the middle, from where the water drips down in front of the grill 30. The dripping water is scattered by the force of the blown air. Because the middle 32*c* is positioned vertically above the rotational center axis of the outdoor fan 51, water dripping down from the middle 32*c* is subjected to the force of blown air having the highest speed, and this water is scattered farther in the form of fine water droplets. Therefore, the water droplets do not readily adhere to and freeze on the grill 30.

(5-2) Second Modification

Figure 5B:
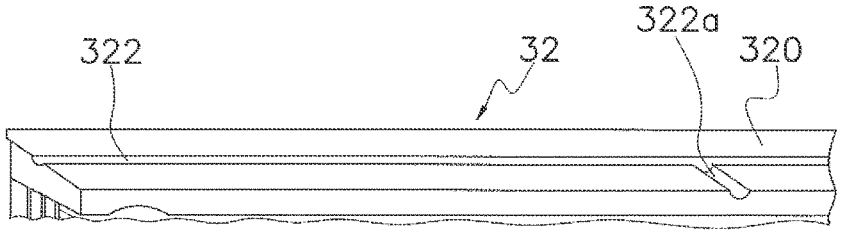
FIG. 5B is a perspective view of an eave part of an outdoor unit according to a second modification.

FIG. 5B is a perspective view of an eave part 32 of an outdoor unit 3 according to a second modification. In FIG. 5B, a groove 322 extending laterally is formed in the top surface 320 of the eave part 32. Furthermore, a middle groove 322*a* is formed in the groove 322 in the middle of the eave part 32, and the middle groove branches along the protruding direction of the eave part 32.

When water droplets accumulate in the eave part. 32 and grow to a certain size, the water droplets enter the groove 322 and move to the left end, the right end, and the middle groove 322*a* in a pulled manner.

Water that has dripped down in front of the grill 30 from the middle groove 322*a* is scattered by the force of the blown air. Because the middle groove 322*a* is positioned vertically above the rotational center axis of the outdoor fan 51, water dripping down from the middle groove 322*a* is subjected to the force of blown air having the highest speed, and this water is scattered farther in the form of fine water droplets. Therefore, the water droplets do not readily adhere to and freeze on the grill 30.

On the other hand, water that has dripped down to the side from the left end or right end spreads over the holding plate 34 and fails down in the same manner as Embodiment 1, and is therefore not described here.

(5-3) Third Modification

Figure 5C:
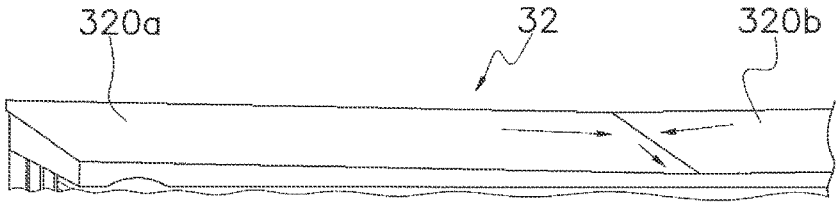
FIG. 5C is a perspective view of an eave part, of an outdoor unit according to a third modification.

FIG. 5C is a perspective view of an eave part 32 of an outdoor unit 3 according to a third modification. In FIG. 5C, in the top surface of the eave part 32 are formed a first inclined surface 320*a* inclined downward from the left end toward the middle, and a second inclined surface 320*b* inclined downward from the right end toward the middle.

Water droplets falling down the first inclined surface 320*a* and the second inclined surface 320*b* of the eave part 32 move along the inclined surfaces toward the middle. Water that has collected in the middle drips down in front of the grill 30 to be scattered by the force of the blown air. Because the middle is positioned vertically above the rotational center axis of the outdoor fan 51, water dripping down from the middle is subjected to the force of blown air having the highest speed, and this water is scattered farther in the form of fine water droplets. Therefore, the water droplets do not readily adhere to and freeze on the grill 30.

(5-4) Fourth Modification

Figure 5D:
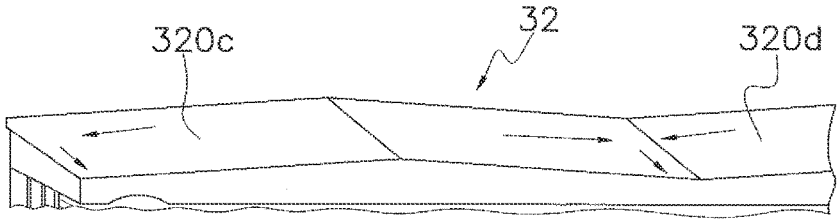
FIG. 5D is a perspective view of an eave part of an outdoor unit according to a fourth modification.

FIG. 5D is a perspective view of an eave part 32 of an outdoor unit 3 according to a fourth modification. In FIG. 5D, the top surface of the eave part. 32 is shaped having two upwardly convex peaked surfaces adjacent to each other. The left peaked surface is designated as a first peaked surface 320*c*, and the right peaked surface is designated as a second peaked surface 320*d*. Water falling down to the left of the apex of the first peaked surface 320*c* moves toward the left end, and water falling down to the right of the apex collects in the middle. Similarly, water falling down to the right of the apex of the second peaked surface 320*d* moves toward the right end, and water falling down to the left of the apex collects in the middle. The water that has collected in the middle drips down in front of the grill 30 to be scattered by the force of the blown air. Because the middle is positioned vertically above the rotational center axis of the outdoor fan 51, water dripping down from the middle is subjected to the force of blown air having the highest speed, and this water is scattered farther in the form of fine water droplets. Therefore, the water droplets do not readily adhere to and freeze on the grill 30.

On the other hand, water that has dripped down to the side from the left end or right end spreads over the holding plate 34 and falls down in the same manner as Embodiment 1, and is therefore not described here.

INDUSTRIAL APPLICABILITY

The present invention is useful as outdoor units not only of air conditioners but of heat-pump-type water heaters as well.

What is claimed is:

1. An outdoor unit of a refrigeration apparatus in which a blow-out opening configured to deliver air from an air-blowing fan is covered by a protective grill, the outdoor unit comprising:

an eave part protruding beyond the grill in a direction along which the air is blown out from a height position above the grill and below a top surface of the outdoor unit, a top surface of the eave part being provided with a water-leading part extending in a horizontal direction intersecting the direction along which the air is blown out, the water-leading part being shaped having at least two upwardly convex areas, with both of two longitudinal ends of the eave part and a middle of the eave part located between the two longitudinal ends of the eave part being formed lower than the at least two upwardly convex areas in the horizontal direction intersecting the direction along which the air is blown out such that the water-leading part leads water dripping down onto the top surface of the eave part to at least one of the longitudinal ends of the eave part and the middle of the eave part.

2. The outdoor unit of the refrigeration apparatus according to claim 1, wherein the water-leading part leads the water dripping down onto the top surface of the eave part to the longitudinal ends of the eave part and the middle of the eave part.

3. The outdoor unit of the refrigeration apparatus according to claim 1, wherein the middle of the eave part is positioned vertically above a rotational center axis of the air-blowing fan.

4. The outdoor unit of the refrigeration apparatus according to claim 1, wherein the water-leading part includes a rib having a predetermined height.

5. The outdoor unit of the refrigeration apparatus according to claim 1, wherein the water-leading part includes a groove having a predetermined depth.

6. The outdoor unit of the refrigeration apparatus according to claim 2, wherein the middle of the eave part is positioned vertically above a rotational center axis of the air-blowing fan.

7. The outdoor unit of the refrigeration apparatus according to claim 2, wherein the water-leading part includes a rib having a predetermined height.

8. The outdoor unit of the refrigeration apparatus according to claim 2, wherein the water-leading part includes a groove having a predetermined depth.

9. The outdoor unit of the refrigeration apparatus according to claim 3, wherein the water-leading part includes a rib having a predetermined height.

10. The outdoor unit of the refrigeration apparatus according to claim 3, wherein the water-leading part includes a groove having a predetermined depth.

* * * * *